United States Patent [19]

Takahashi et al.

[11] 4,123,265

[45] Oct. 31, 1978

[54] METHOD OF PRODUCING FERROUS SINTERED ALLOY OF IMPROVED WEAR RESISTANCE

[75] Inventors: Kentaro Takahashi; Shigeru Urano, both of Ohmiya, Japan

[73] Assignee: Nippon Piston Ring Co., Ltd., Tokyo, Japan

[21] Appl. No.: 771,854

[22] Filed: Feb. 23, 1977

Related U.S. Application Data

[63] Continuation of Ser. No. 671,781, Mar. 30, 1976, abandoned, and a continuation-in-part of Ser. No. 551,815, Feb. 21, 1975, abandoned.

[30] Foreign Application Priority Data

Feb. 21, 1974 [JP] Japan ..... 49-19971

[51] Int. Cl.$^2$ ..... B22F 1/00

[52] U.S. Cl. ..... 75/211; 75/200; 428/567; 428/569

[58] Field of Search ..... 75/200, 211, 228; 29/182, 182.1

[56] References Cited

U.S. PATENT DOCUMENTS

| | | | |
|---|---|---|---|
| 3,414,391 | 12/1968 | Brab | 29/182.1 |
| 3,795,961 | 3/1974 | Takahashi et al. | 29/182 |
| 3,806,325 | 4/1974 | Niimi et al. | 29/182.1 |
| 3,827,863 | 8/1974 | Takahashi et al. | 29/182.1 |
| 3,856,478 | 12/1974 | Iwata et al. | 29/182 |

*Primary Examiner*—Benjamin R. Padgett
*Assistant Examiner*—J. L. Barr
*Attorney, Agent, or Firm*—Sughrue, Rothwell, Mion, Zinn and Macpeak

[57] ABSTRACT

A method of producing a ferrous alloy material having improved wear resistance comprising (1) mixing powders of a ferrous alloy, tungsten and optionally at least one element selected from the group consisting of C, Ni, Mn, Mo, Cr, and Cu, (2) sintering the mixture of powders of step (1) to form a sintered product, (3) infiltrating the sintered product of step (2) with molten copper or a copper alloy to produce an infiltrated sintered product and (4) cooling the infiltrated sintered product of step (3).

2 Claims, 1 Drawing Figure

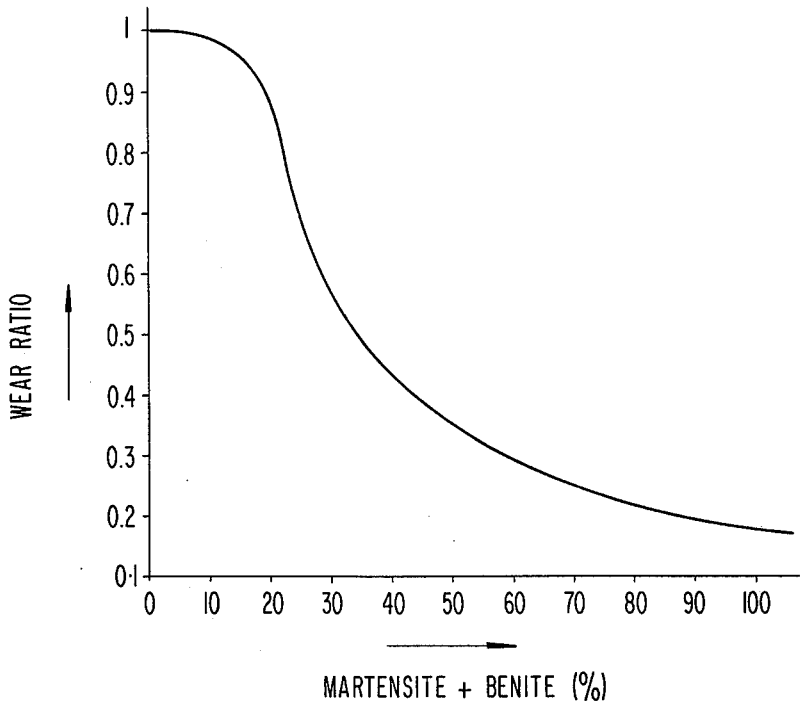
WEAR RATIO
1
0.9
0.8
0.7
0.6
0.5
0.4
0.3
0.2
0·1
0
10
20
30
40
50
60
70
80
90
100
MARTENSITE + BENITE (%)

METHOD OF PRODUCING FERROUS SINTERED ALLOY OF IMPROVED WEAR RESISTANCE

CROSS-REFERENCE TO RELATED APPLICATION

This is a continuation of application Ser. No. 671,781, filed Mar. 30, 1976, now abandoned.

This applicaion is a continuation-in-part of U.S. Application Ser. No. 551,815, filed Feb. 21, 1975 now abandoned.

BACKGROUND OF THE INVENTION

1. FIELD OF THE INVENTION

The present invention relates to a method of producing ferrous sintered alloys which can be used as materials for construction of mechanical elements which require improved wear resistance during high temperature use, such as, for example, valve seats. More specifically, the present invention, provides a method for producing a high density ferrous sintered alloy whose wear resistance is increased by the dispersion of hard particles within the alloy matrix such that the alloy need not be thereafter hardened by a subsequent heat treatment.

2. DESCRIPTION OF THE PRIOR ART

Various process for manufacturing wear resistant ferrous sintered alloys have been heretofore proposed wherein the wear resistance has been increased by the use of high alloy powders, by the employment of hard particles dispersed within the alloy matrix, and by the alloy processing step of heat treatment and forging. Considering the matrix characteristics of ferrous alloys, three techniques may be employed for improving wear resistance: (1) improving the density of the alloy, (2) hardening the alloy matrix, and (3) dispersing hard particles into the alloy. Of course, combinations of these techniques may also be considered.

Forging has been employed to manufacture high strength alloy materials in order to improve the density and harden. However, when utilizing forging, dispersing hard particles into the alloy is not practical in terms of achieving good mold life and the like, and therefore a sintering method has been normally employed to treat the alloys containing the dispersed hard particles so that the density is relatively low.

Furthermore, the prior art method for infiltrating Cu into a ferrous sintered alloy has been to infiltrate the Cu simultaneously with, or at some stage after, sintering. In this prior art method, however, the alloys cannot be mass-produced due to the poor dimensional stability and the poor machinability of the alloy produced, in part because the matrix must be hardened by a rapid cooling step, and in part due to the particular infiltration technique normally employed.

On the other hand, the present invention provides an excellent alloy with respect to machinability due to the fact that a pearlite matrix (which includes ferrite or carbide) is formed into a micro structure after the primary sintering.

In addition, by the application of the present infiltration technique alloy elements and infiltration elements can be so combined and diffused with one another so that part or all of the base structure may be formed into a high hardness martensite or bainite, thus increasing the wear resistance.

Furthermore, in accordance with the present invention, the final cooling rate may be controlled such that the need for additional heat treatment is eliminated.

SUMMARY OF THE INVENTION

The method of the present invention has been developed in order to improve the disadvantages noted above with respect to the prior art, and the invention provides a method for producing a wear resistant ferrous sintered alloy comprising (1) mixing powders of a ferrous alloy, tungsten and, optionally, one or more of C, Ni, Mn, Mo, Cr, and Cu, (2) sintering the mixture of powders of step (1) so as to form a sintered product with a pearlite matrix micro structure, (3) infiltrating the sintered product of step (2) which includes the pearlite micro structure (which contains ferrite or carbide) with either molten Cu or a molten Cu alloy (principally comprising Cu) to produce an infiltrated sintered product and (4) cooling the infiltrated sintered product of step (3).

BRIEF DESCRIPTION OF THE DRAWINGS

The figure shows the test results on the ratio of wear obtained using ferrous alloy materials of this invention having various proportions (% by weight) of martensite and bainite.

DETAILED DESCRIPTION OF THE INVENTION

The ferrous sintered alloy of this invention having improved wear resistance is produced from a powdery mixture, e.g., having a particle size of less than about 200 mesh, of a ferrous alloy material, e.g., comprising more than about 50% by weight iron and other conventional alloying elements, and powders of tungsten as essential components and optionally powders of one or more of C, Ni, Mn, Mo, Cr and Cu. While these latter described components are optional, their presence in the ferrous sintered alloy ultimately produced gives rise to advantageous properties. The resulting powdery mixture is compacted in step (2) under a pressure of about 4 to 6 ton/cm$^2$ pressure and then the thus compacted mixture is sintered at a temperature of about 1,100 to 1,200° C. for about 30 minutes to 2 hours so as to form a pearlite matrix micro structure.

In step (3), Cu or a Cu alloy comprising Cu—Sn, Cu—Sn—Pb, etc., and which is predominantly copper, is infiltrated into the ferrous alloy matrix porduced by sintering. The infiltration step (3) can be accomplished, e.g., by dipping the sintered ferrous alloy into a bath of the molten Cu or the molten Cu alloy, with the bath being held at a temperature above the melting point of the Cu or the Cu alloy up to a temperature less than the lowest sintering temperature used to produce the sintered ferrous alloy of step (2). In this step the molten Cu or Cu alloy infiltrates into the interstices between the sintered alloy powders of the sintered matrix formed in step (2). For example, pure Cu can be infiltrated above its melting point up to less than about the sintering temperature employed in step (2), e.g., up to less than about 1,100° C. where the lowest sintering temperature of about 1,100° C. is employed and can be infiltrated, e.g., for about 45 minutes.

The amount of the Cu or the Cu alloy infiltrated generally ranges from about 50 to 85% of the interstitial volume. It is possible to infiltrate until 100% of the interstitial volume has been filled, but it is preferable to infiltrate until about 85% of the interstitial volume has been filled on considering production variations. Where less than about 50% of the interstitial volume has been filled, the distribution of the martensite and/or the bainite structure through the matrix becomes non-homogenous. The content of the alloying elements in the Cu alloy can vary with Cu being predominantly present, e.g., above about 50% by weight, and the allowying elements are selected depending on the sintering temperature of the Fe alloy, end-use purposes and the end-use conditions.

Once the sintered matrix has been infiltrated with the molten Cu or Cu alloy as described above, the sintered matrix is cooled, e.g., by allowing the sintered matric to cool naturally or by affirmatively cooling the sintered matrix, e.g., to above 200° over a 2 hour period.

A machining step may be employed, if desired, between the sintering step (2) and the infiltrating (3). Of the C, Ni, Mn, Mo, Cr and Cu optional elements which are mixed with the ferrous alloy powders in step (1), each interact with the subsequently infiltrated Cu or Cu alloy (which principally comprises Cu) in step (3) such that more than 10% of the micro strucutre of the resulting alloy is converted into a martensite and/or bainite matrix of high hardness during the cooling step (4).

The quantity of the above-described high hardness martensite or bainite matrix must be about 10% or more of the total alloy to obtain the desired wear resistance, but the exact amount varies and is dependent on the quantity of and type of alloy elements, the particle size, and the cooling rate in step (4). Since a rough machining before infiltrating is often employed as s shaping technique, the present alloy must principally comprise a pearlite matrix having excellent abrasion properties and contain a small amount of ferrite as a result of the sintering. In order to improve the abrasion properties on machining it is necessary for the matrix produced in step (2) to have a pearlite or ferrite and carbide structure. A suitable range of hardness for the matrix thus produced is an HRB of about 71 to 95 and this hardness can be changed by the sintering conditions employed.

Alloy elements in a certain quantity are employed to retain a pearlite matrix as sintered in order to imprive the wear resistance. W is necessary to convert the structure into a martensite and/or bainite structure after infiltrating. The amount of W employed depends on the raw materials, namely, on the mixed powder, employed. The necessary quantity is generally within the range of about 0.5 to 5.0% by weight. With the use of less than about 0.5% by weight W a poor martensite and/or bainite structure occurs. With the use of up to about 5% by weight W a complete martensite and/or bainite structure occurs and use of over about 5% by weight W is unneccessary. C, Mn and Cr, as optional components added do not have the effect of promoting the transformation of the structure to a martensite and/or bainite structure but do have the effect of improving wear resistance. The addition of Ni and/or Cu as optional components have an enhancing effect on promoting the martensite and/or bainite structure. The amount of martensite and/or bainite structure formed can be varied by employing Mo and changing the amount of Mo.

The amount of the martensite and/or bainite present in the ultimate infiltrated product obtained directly affects the wear resistance obtained with the sintered ferrous alloy product by the method of this invention as shown graphically in the attached drawing and in the table set forth below.

| Martensite + Bainite Microstructure (area ratio (%)) | Wear Quantity ($mm^2$) |
|---|---|
| 5 | 0.0212 |
| 10 | 0.0148 |
| 30 | 0.0140 |
| 50 | 0.0135 |
| 80 | 0.0129 |
| 100 | 0.0118 |

It can be seen from these results that a marked wear resistance is obtained where about 10% or more of the alloy micro structure has a martensite and/or bainite matrix.

The following example is given to illustrate the present invention in greater detail. Unless otherwise indicated all parts, percents, ratios and the like are by weight.

EXAMPLE

Powders which included iron powder, graphite powder, pure Ni powder (below 200 mesh), and Fe-Mo powder (below 150 mesh) were mixed in sufficient quantities to result in a mixed powder containing by weight 1.1% carbon, 0.8% Ni, 1% of Mo and 1% of W. Zinc stearate was then added in an amount of 1%, and the total mixture was formed under a pressure of 6 tons/$cm^2$ and sintered at a temperature of 1, 120° C. in an ammonia cracked gas atmosphere. The matrix formed was pearlite, and the Fe-Mo particles were uniformly dispersed. A sample from this sintered alloy was removed for density and hardness evaluations.

Thereafter, a sample of this sintered matrix was infiltrated with molten Cu, and subsequently cooled. The marix was composed of 80% martensite and bainite.

The properties of the sample of the sintered alloy before infiltration with the molten Cu and after the infiltration with the molten Cu were evaluated. The density and hardness results obtained are shown in Table 1 below.

Table 1

| Alloy Sample | Alloy Composition (%) C | Ni | Mo | Fe | Properties Density ($g/cm^3$) | Hardness |
|---|---|---|---|---|---|---|
| Alloy according to Present Invention (after Cu infiltration) | 1.1 | 0.8 | 1.0 | Balance | 7.80 | (HRC) 51 |
| Comparative Alloy (before Cu infiltration) | 1.1 | 0.8 | 1.0 | Balance | 6.55 | (HRB)87 |

The comparative alloy (before Cu infiltration) and the alloy of this invention (after Cu infiltration) produced as described above were then each subjected to wear resistance testing as valve seat materials under the following conditions.

| | |
|---|---|
| Valve Material: | SuH 31 B |
| Temperature: | 500° C, under combustion using a mixture of propane and air |
| Spring Pressure: | 35 Kg |

-continued

| | |
|---|---|
| Number of Valve Rotations: | 8–10 rpm |
| Number of Repetitions: | $8 \times 10^5$ |
| Repetition Rate: | 3000 rpm |
| Velocity at Valve Closing: | 0.5 m/sec. |

The test results obtained are shown in Table 2 below.

Table 2

| Alloy Material | Average Wearing Quantity ($mm^2$)* |
|---|---|
| Alloy according to the Present Invention | 0.0121 |
| Comparative Alloy | 0.0287 |

*Five replications

It can be seen from the test results obtained above that an alloy material produced according to the method of this invention results in a markedly less wearing quantity in comparison with the comparative alloy and thus the wearing resistance of the alloy produced by the method of this invention is markedly superior to the comparative alloy.

While the invention has been described in detail and with reference to specific embodiments thereof, it will be apparent to one skilled in the art that various changes and modifications can be made therein without departing from the spirit and scope thereof.

What is claimed is:

1. A method of producing a wear-resistant sintered ferrous alloy including the steps of (1) mixing powders of a ferrous alloy containing more than about 50% by weight iron, tungsten in the range of about 0.5 to 5.0% by weight, and optionally at least one of an element selected from the group consisting of C, Ni, Mn, Mo, Cr and Cu, (2) sintering the mixture of powders of step (1) to produce a sintered product, (3) infiltrating into the sintered product of step (2) a component selected from the group consisting of copper or a copper alloy principally containing copper at a temperature above the melting point of the copper or the copper alloy to produce an infiltrated sintered product and (4) cooling the infiltrated sintered product of step (3); the improvement comprising said mixture of powders of step (1) having a composition sufficient to cause the production of martensite and bainite matrixes during the cooling step (4) in an amount of at least about 10% of the alloy microstructure.

2. The method of claim 1, including machining the sintered product of step (2) prior to said infiltration of step (3).

* * * * *